US007342480B2

(12) United States Patent
Tsukada

(10) Patent No.: US 7,342,480 B2
(45) Date of Patent: Mar. 11, 2008

(54) CHIP RESISTOR AND METHOD OF MAKING SAME

(75) Inventor: Torayuki Tsukada, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 284 days.

(21) Appl. No.: 10/517,943

(22) PCT Filed: Jun. 12, 2003

(86) PCT No.: PCT/JP03/07456

§ 371 (c)(1),
(2), (4) Date: Dec. 13, 2004

(87) PCT Pub. No.: WO03/107361

PCT Pub. Date: Dec. 24, 2003

(65) Prior Publication Data

US 2005/0200451 A1 Sep. 15, 2005

(51) Int. Cl.
*H01C 1/012* (2006.01)

(52) U.S. Cl. ..... 338/309; 338/195; 338/332

(58) Field of Classification Search ..... 338/195, 338/307–309, 313–314, 327, 332, 254
See application file for complete search history.

(56) References Cited

U.S. PATENT DOCUMENTS 5,164,698 A * 11/1992 Palanisamy ..... 338/307
5,907,274 A * 5/1999 Kimura et al. ..... 338/309
6,144,287 A * 11/2000 Komeda ..... 338/195

FOREIGN PATENT DOCUMENTS

JP 2000-216012 8/2000
JP 2001-118701 4/2001
JP 2002-050501 2/2002
JP 2002-057009 2/2002
JP 2004-22658 * 1/2004

* cited by examiner

*Primary Examiner*—Richard K. Lee
(74) *Attorney, Agent, or Firm*—Hamre, Schumann, Mueller & Larson, P.C.

(57) ABSTRACT

A chip resistor includes a resistor element of a rectangular solid made of an alloy composed of high-resistant metal and low-resistant metal. The resistor has connection terminal electrodes disposed at the ends of the resistor element that are spaced longitudinally of the rectangular solid. The resistance of the chip resistor is lowered without incurring an increase in the temperature coefficient of resistance and the weight. A plating layer is formed on the resistor element, where the plating element is made of pure metal having a lower resistance that that of the alloy constituting the resistor element.

20 Claims, 14 Drawing Sheets

CHIP RESISTOR AND METHOD OF MAKING SAME

BACKGROUND OF THE INVENTION

The present invention relates to a chip resistor having low resistance of no greater than e.g. 1Ω, and also relates to a method of making the same.

In a conventional chip resistor of the above-mentioned type, as disclosed in JP-A-2001-118701 for example, the resistor element is formed of an alloy into a rectangular solid, the alloy being composed of a base material metal, such as copper, having low resistance (hereinafter referred to as low-resistant metal) and a metal having high resistance (hereinafter referred to as high-resistant metal), such as nickel, which is greater than that of the base material metal. In the resistor element, the rectangular solid has ends provided with connection terminal electrodes to be connected to a printed circuit board or the like by soldering, for example.

The resistance between the connection terminal electrodes of such a chip resistor largely depends on the resistivity of the alloy making the resistor element. The resistivity of an alloy decreases as the percentage of low-resistant metal in the alloy becomes higher as compared to the high-resistant metal, whereas it increases as the percentage of high-resistant metal in the alloy becomes higher as compared to the low-resistant metal. In other words, the resistivity of the alloy decreases in proportion to the percentage of the low-resistant metal relative to the high-resistant material, while increasing in proportion to the percentage of the high-resistant metal relative to the low-resistant metal.

Thus, in a conventional chip resistor including a resistor element of a rectangular solid having predetermined length and width, the resistance between the connection terminal electrodes, or the resistivity of the chip resistor, is reduced by one or both of the following methods:

(1) Using an alloy containing an increased ratio of low-resistant metal relative to high-resistant metal.

(2) Increasing the thickness of the resistor element.

Generally, however, a metal material has a temperature coefficient of resistance, which describes the resistance change in relation to the temperature. It is known that the temperature coefficient of resistance is higher in a pure metal than in an alloy.

When the option (1) is taken to reduce the resistance of the chip resistor, the ratio of the low-resistant metal (base material metal) in the alloy making the resistor element is increased, whereby the alloy has increased purity of the low-resistant metal (base material metal). Unfavorably, this results in a higher temperature coefficient of resistance in the chip resistor.

When the option (2) is taken to reduce the resistance of the chip resistor, the thickness of the resistor element increases, whereby the weight of the chip resistor becomes greater, and it becomes difficult to bend the lengthwise-spaced ends of the resistor element into connection terminals. Additionally, it becomes significantly difficult to perform trimming adjustment by making a trimming groove in the resistor element for adjustment of the resistance.

Further, most of pure metals have positive temperature coefficient of resistance (directly proportional to temperature), whereas some alloys composed of pure metals have negative temperature coefficient of resistance (inversely proportional to temperature). When an alloy with such negative temperature coefficient of resistance is used to make a resistor element, unfavorably the negative temperature coefficient of resistance appears as a minus temperature coefficient of resistance of the chip resistor.

As another example of such a low-resistant chip resistor, JP-A-2002-57009 discloses a conventional structure, according to which a resistor element comprises a metal plate or rectangular chip formed of an alloy of low-resistant metal such as copper and high-resistant metal such as nickel. The lower surface of the resistor element has lengthwise-spaced ends to which connection terminals are attached, the terminals being made of a metal having a lower resistance than the alloy making the resistor element. The surfaces of the connection terminals are formed with metal-plated layers for facilitating soldering to e.g. a printed circuit board.

However, in the chip resistor of JP-A-2002-57009, metal connection terminals to be soldered to a printed circuit board are attached to the ends of the lower surface of the resistor element. Due to this structure, melted solder may swell up to the lower surface of the resistor element beyond the connection terminals, whereby the resistance can change. To avoid such change in resistance, spacing between the lower surface of the resistor element and a printed circuit board should be increased. Unfavorably, this structure increases the entire height and the weight of the chip resistor.

SUMMARY

A chip resistor having low resistance comprises a resistor element formed an alloy of high-resistant metal and low-resistant metal into a rectangular solid, and connection terminal electrodes formed at ends of the resistor element. The resistor element has a surface formed with a plating layer of pure metal with resistance lower than the resistance of the alloy making the resistor element. The alloy making the resistor element has a negative temperature coefficient of resistance. The resistor element is formed with a sectional area reducing portion filled with the plating layer. The plating layer on the surface of the resistor element is divided between the connection terminal electrodes, or is narrowed at least partially between the connection terminal electrodes. The connection terminal electrodes are integrally extended from ends of the resistor element toward a lower surface of the resistor element. The plating layer is extended into a surface of the extended electrodes. The metal plates serving as connection terminal electrodes are fixed to ends of the lower surface of the resistor element. An insulator covers an upper surface of the resistor element formed with the plating layer, while also covering a portion between the connection terminal electrodes on the lower surface of the resistor element. At least the lower surface of the resistor element except for ends thereof is covered by an insulator. The lower surface of the resistor element is formed with a metal plating layer disposed at the ends non-covered by the insulator. The metal layers serve as the connection terminal electrode of the resistor element. The metal layers formed at the ends of the lower surface have a thickness equal to or larger than a thickness of the insulator covering the lower surface of the resistor element. The upper surface and right and left side surfaces of the resistor element are covered by an insulator.

Also disclosed is a method of making a chip resistor having low resistance comprising the steps of: preparing a lead frame integrally formed with a plurality of lead bars for forming resistor elements, the preparation using an alloy plate of high-resistance metal and low-resistance metal; forming a pure metal plating layer on a surface of the resistor element in each bar of the lead frame; adjusting the resistance of the resistor element in each bar of the lead frame;

and cutting the resistor element in each bar off the lead frame after an insulator for covering the resistor element is formed.

Further disclosure is of a method of making a chip resistor having low resistance comprises the steps of: preparing a laminated metal material by fixing a resistor element alloy plate and a connection terminal electrode metal plate to each other, the alloy plate being made of an alloy composed of high-resistance metal and low-resistance metal and being formed integrally with a plurality of resistor elements of a rectangular solid arranged, the connection terminal metal plate being made of a metal having resistance lower than the alloy plate; removing portions of the connection terminal electrode metal plate so as to leave connection terminal electrodes after a plating layer of pure metal is formed on an upper surface of the resistor element alloy plate in the laminated material metal plate, or forming a plating layer of pure metal on an upper surface of the resistor element alloy plate after portions of the connection terminal electrode metal plate in the laminated material metal plate are removed so as to leave connection terminal electrodes; forming insulators for covering the upper surface of the alloy plate and a part of the lower surface of the connection terminal electrode metal plate other than the connection terminal electrodes; and cutting the laminated material metal plate into the resistor elements.

A method of making a chip resistor having low resistance comprises the steps of: making a rectangular resistor element from a metal plate; forming a pure metal plating layer on a surface of the resistor element; forming an insulator for covering at least a lower surface of the resistor element at a portion other than ends thereof; and forming metal plating layers serving as connection terminal electrodes of the resistor element at the ends of the lower surface of the resistor element which are non-covered by the insulator.

A method of making a chip resistor having low resistance comprises the steps of: making a rectangular resistor element from a metal plate, forming a pure metal plating layer on a surface of the resistor element; forming insulators for covering an upper surface; a lower surface, and right and left side surfaces of the resistor element except for the ends of the lower surface; and forming metal plating layer for serving as connection terminal electrodes of the resistor element at the ends of the lower surface of the resistor element which are non-covered by the insulator.

A method of making a chip resistor having low resistance comprises the steps of: preparing a lead frame integrally formed with a plurality of lead bars for making resistor elements, the preparation using a metal plate; forming a pure metal plating layer on a surface of the resistor element in each bar of the lead frame; forming an insulator for covering at least a lower surface of the resistor element in each bar of the lead frame except for the ends of the lower surface; and cutting off the resistor element in each lead bar from the lead frame before metal plating layers serving as connection terminal electrodes of the resistor element are formed at the ends of the lower surface of the resistor element which are non-covered by the insulator, or forming metal plating layers serving as connection terminal electrodes of the resistor element in each bar at insulator-non-covering ends of the lower surface of the resistor element before the resistor element is cut off from the lead frame.

As described above, a resistor element formed of an alloy of high-resistance metal and low-resistance metal into a rectangular solid includes a surface formed with a plating layer which is made of pure metal with resistance lower than the alloy making the resistor element. Due to this arrangement, the resistance between the connection terminal electrodes is lowered by the pure metal plating layer which is formed on the alloy resistor element. Thus, the resistance between the connection terminal electrodes, which is resistance of the chip resistor, can be lowered without increasing the percentage of the low-resistance metal relative to the high-resistance metal in the alloy making the resistor element, and also without increasing the thickness of the resistor element. As resistance of a chip resistor with a predetermined length and width can be lowered without increasing the percentage of the low-resistance metal, hence without making its purity closer to low-resistance metal (base material metal), the above-described temperature coefficient of resistance is not increased. Further, as the thickness of the resistor element is not increased, the above structure reliably prevents difficulty in adjusting resistance by trimming and in bending process of the connection terminal electrodes, as well as increase in weight.

The alloy making the resistor element has a negative temperature coefficient of resistance, whereas the pure metal plating layer has a positive temperature coefficient of resistance, so that the negative temperature coefficient of resistance of the resistor element can be canceled out by the positive temperature coefficient of resistance of the plating layer formed on the surface of the resistor element. Thus, the temperature coefficient of resistance of the chip resistor does not become negative, or even if negative, it can be close to a positive value. The resistance of the chip resistor can be lowered further and/or adjusted as required. Further, the arrangements disclosed herein facilitate forming process of connection terminal electrodes at ends of the resistor element, and soldering process of the connection terminal electrodes on a printed circuit board by the plating layer formed on the surfaces of the connection terminal electrodes. The plating layer formed on the surfaces of the connection terminal electrodes can also serve to further lower resistance of the chip resistor element. The metal plates that may serve as connection terminal electrodes are fixed to ends of the lower surface of the resistor element, and an insulator covers a portion between the connection terminal electrodes on the lower surface of the resistor element. Due to this, when the chip resistor is soldered to e.g. a printed circuit board, the insulator covering the lower surface prevents melted solder from coming into contact with the lower surface of the resistor element. Thus, the thickness of the connection terminal electrodes can be reduced, while reliably preventing change in resistance at the resistor element, thereby reducing the height of the chip resistor, as well as its weight. Further, a plurality of chip resistors as the one described above can be made simultaneously at low production costs. The insulator covers at least the lower surface of the resistor element at a portion other than the ends thereof, and metal layers are formed on the lower surface of the resistor element at the ends without the insulator to serve as the connection terminal electrode of the resistor element. Due to this arrangement, the connection terminal electrodes at the ends of the resistor element can be formed with a thin metal layer, thereby reducing the height of the chip resistor.

Additionally, when the chip resistor is soldered to e.g. a printed circuit board, the insulator covering the lower surface prevents melted solder from coming into contact with the lower surface of the resistor element. Thus, the thickness of the connection terminal electrodes can be reduced, while reliably preventing change in resistance at the resistor element, thereby reducing the height of the chip resistor, as well as its weight.

Each of the metal layers formed at the ends of the lower surface has a thickness equal to or larger than the insulator covering the lower surface of the resistor element. Due to this arrangement, when the chip resistor is soldered to e.g. a printed circuit board, the metal layers are nearly or completely prevented from lifting up from the printed circuit board, thereby improving reliability and firmness of the soldering. Further, the methods certain steps of the methods disclosed herein do not need fixing process of two metal plates and process for partly cutting one of the metal plates, thereby remarkably reducing production costs.

The insulator covers the upper surface and side surfaces of the resistor element. Due to this arrangement, the insulator reliably prevents melted solder from coming into contact with the upper surface and/or the side surfaces of the resistor element, thereby reliably reducing change in resistance. Barrel-plating may be employed to form the metal layer, which facilitates the plating process, thereby reducing the production cost further.

A plurality of chip resistors may be made simultaneously by using a single lead frame, which contributes to further reduction in production cost.

DETAILED DESCRIPTION OF PREFERRED EMBODIMENTS

Preferred embodiments according to the present invention will be described with reference to the drawings.

Figure 1:
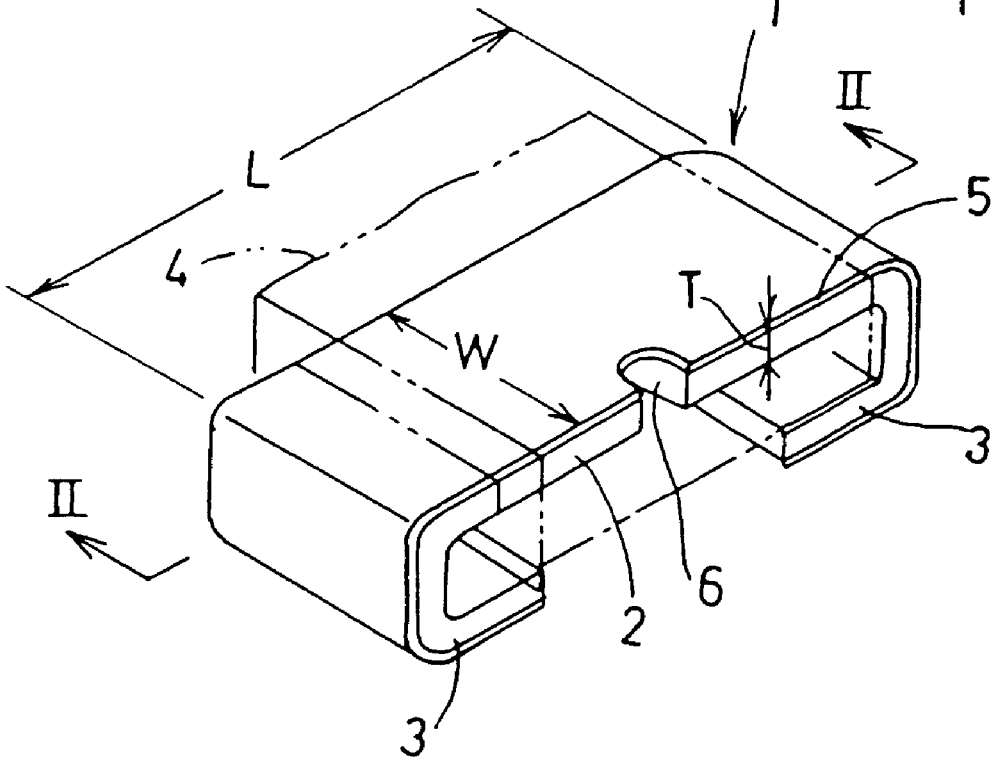
FIG. 1 is a perspective view illustrating a chip resistor according to a first embodiment of the present invention.
Figure 2:
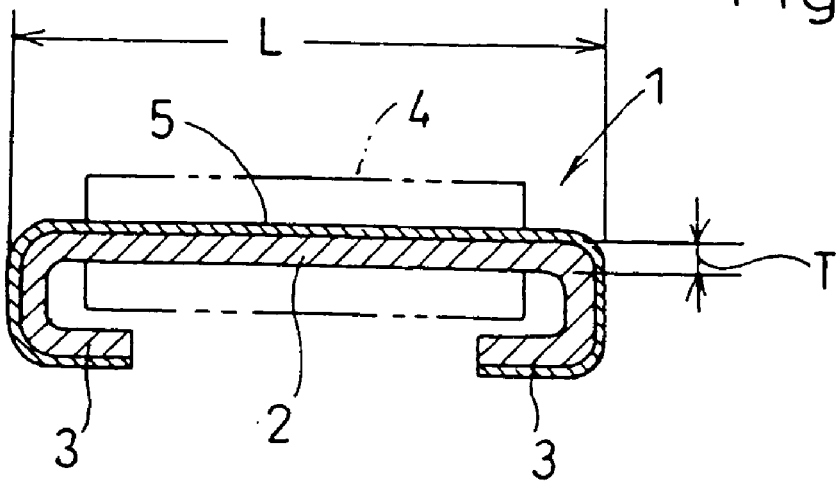
FIG. 2 is a section view taken along lines II-II in FIG. 1.

FIGS. 1-2 illustrate a chip resistor according to a first embodiment.

The chip resistor 1 includes a resistor element 2 which is a rectangular solid having a length L, width W, and a thickness T, a pair of connection terminal electrodes 3 which are integrally formed with the resistor element 2 at both ends of the resistor element 2, each electrode being bent toward the lower surface of the resistor element 2, and an insulator 4 made of heat-resistant synthetic resin or glass for covering the resistor element 2.

The resistor element 2 and the terminal electrodes 3 are made of an alloy of a metal with low resistance (hereinafter referred to as low-resistant metal) and a metal with high resistance (hereinafter referred to as high-resistant metal), such as copper-nickel alloy, nickel-chrome alloy, or iron-chrome alloy.

As readily understood, one or both of such low-resistant metal and high-resistant metal may be replaced by an alloy of a low-resistant metal and a high-resistant metal.

A surface of the resistor element 2 is formed with a plating layer 5 which is made of a pure metal, such as copper or silver, which has resistance lower than that of the alloy making the resistor element 2. The plating layer 5 is formed to extend onto the surfaces of the respective terminal electrodes 3.

As readily understood, the plating layer 5 is formed before the resistor element 2 is covered with the insulator 4. As shown in FIG. 1, a reference numeral 6 designates a trimming groove formed by laser irradiation with respect to the resistor element 2 for adjustment of resistance. Adjustment of resistance by the trimming groove 6 is performed after the plating layer 5 is formed and before the resistor element 2 is covered by the insulator 4.

As described above, the surface of the resistor element 2 made of an alloy of high-resistant metal and low-resistant metal is formed with the plating layer 5 made of pure metal having resistance lower than that of the alloy making the resistor element. Thus, the resistance between the terminal electrodes 3 is lowered by the pure metal plating layer 5 than when only the resistor element 2 made of alloy is provided. In this manner, the resistance between the terminal electrodes 3, namely the resistance of the chip resistor 1, can be lowered without increasing the percentage of the low-resistant metal relative to the high-resistant metal in the alloy making the resistor element 2, and without increasing the thickness T of the resistor element 2.

The chip resistor 1 is soldered to e.g. a printed circuit board at the terminal electrodes 3. In this case, since the plating layer 5 formed on resistor element 2 is extended to cover the surface of the terminal electrodes 3, the soldering process of the terminal electrodes 3 to a printed circuit board is facilitated due to the plating layer 5 on the surfaces of the terminal electrodes 3. The plating layer 5 formed on the terminal electrodes 3 can also serve to lower resistance of the chip resistor element 1.

Figure 3:
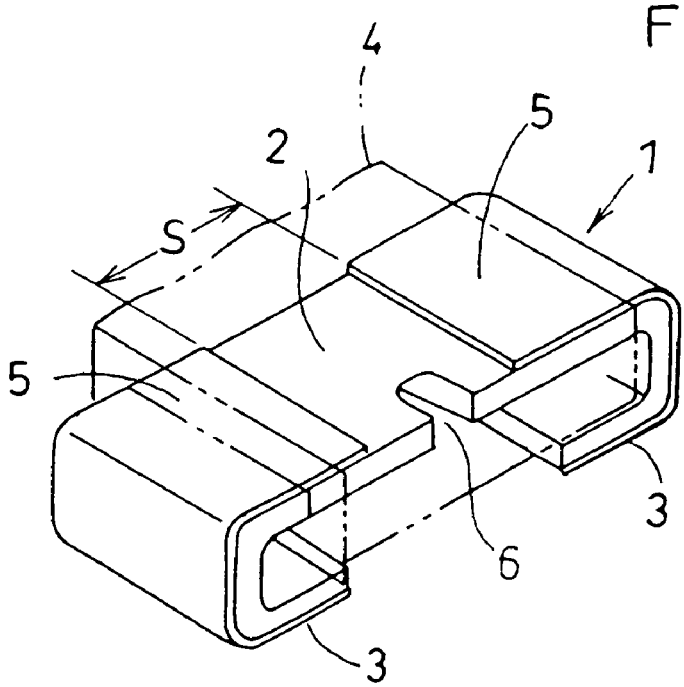
FIG. 3 is a perspective view illustrating a first modified example of the chip resistor.
Figure 4:
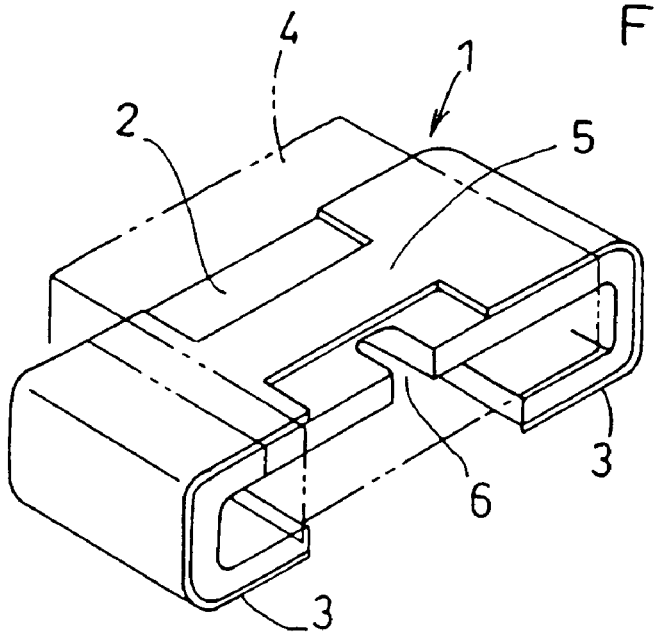
FIG. 4 is a perspective view illustrating a second modified example of the chip resistor.
Figure 5:
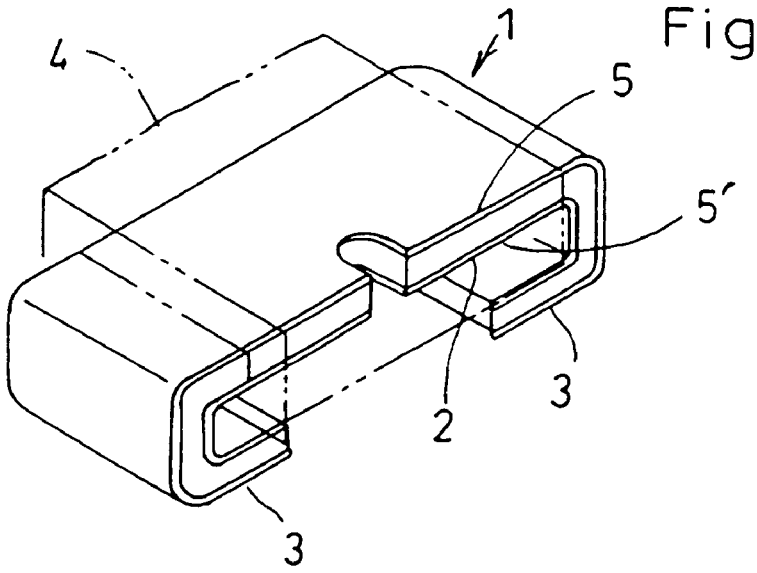
FIG. 5 is a perspective view illustrating a third modified example of the chip resistor.

The resistance of the chip resistor 1 can be increased by dividing the plating layer 5 by a length S between the terminal electrodes 3, 3 as shown in FIG. 3, or by forming a narrowed portion between the terminal electrodes 3, 3 as shown in FIG. 4, or by reducing the thickness of the plating layer 5. On the other hand, the resistance of the chip resistor can be lowered by forming a plating layer 5' on the lower surface of the resistor element 2 as shown in FIG. 5, or by increasing the thickness of the plating layer 5. In this way, the resistance of the chip resistor can be determined by selecting the above structure.

Figure 6:
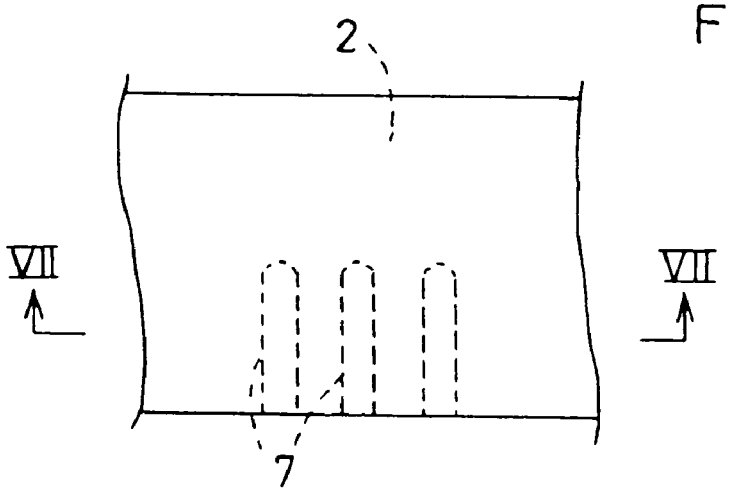
FIG. 6 is a plan view partially illustrating the third modified example of the chip resistor.
Figure 7:
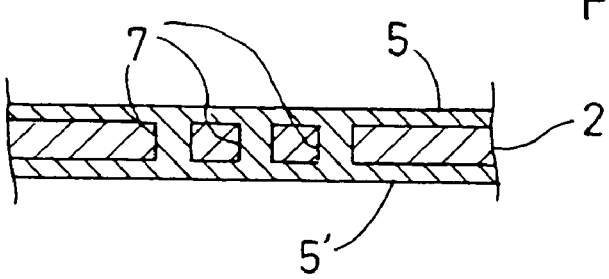
FIG. 7 is a section view taken along lines VII-VII in FIG. 6.

As shown in FIGS. 6-7, the resistor element 2 may be further formed with one or more slots 7 which laterally extend from a side surface of the resistor element 2, or formed with through-holes, so that the sectional area of the resistor element 2 is partly reduced. The sectional area reducing portion such as a slit 7 or through-hole may be filled with the plating layer 5 formed on the upper surface of the resistor element 2 or by the plating layers 5, 5' formed on the upper and lower surfaces of the resistor element 2, so that the resistance of the chip resistor 1 can be further reduced to a very low resistance.

The plating layers 5, 5' are generally made of pure metal having positive temperature coefficient of resistance. Thus, for example, the resistor element 2 may be made of an alloy having negative temperature coefficient of resistance, such as a copper-nickel alloy composed of 43-45 wt % nickel and copper for the balance, while the plating layers 5, 5', formed on the resistor element 2, may be made of pure metal having positive temperature coefficient of resistance. With such an arrangement, the negative temperature coefficient of resistance of the resistor element 2 can be canceled out by the positive temperature coefficient of resistance of the plating layer 5. In this manner, it is possible to prevent the chip resistor 1 from having a negative temperature coefficient of resistance, or reduce the negative temperature coefficient of resistance of the chip resistor 1.

Next, a method of making the chip resistor 1 according to the first embodiment is described below.

Figure 8:
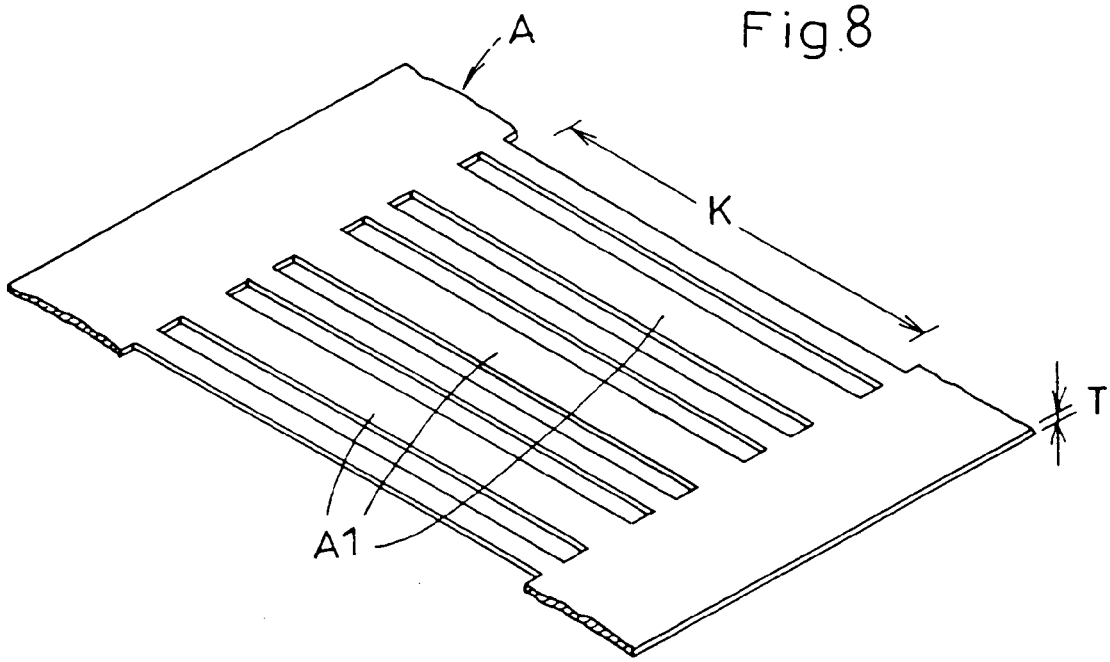
FIG. 8 is a perspective view illustrating a first step of a method of making the chip resistor.

As shown in FIG. 8, a lead frame A is punched out of an alloy plate having a thickness T. The lead frame is integrally formed with a plurality of lead bars A1 spaced from each other at appropriate intervals in the longitudinal direction of the frame, each of the bars being used for forming a resistor element 2 with a determined length L and connection terminal electrodes 3 at the ends thereof. Each of the bars A1 has an upper surface portion of a length K which corresponds to the total length of the resistor element 2 and the terminal electrodes 3. The plating layer 5 of pure metal is formed on this upper surface portion.

Figure 9:
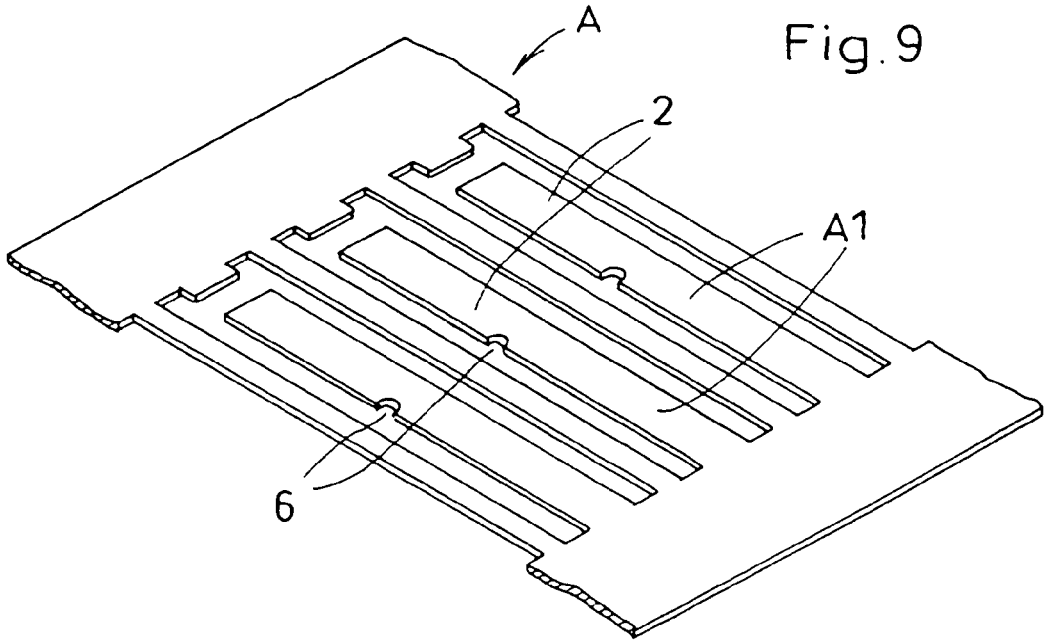
FIG. 9 is a perspective view illustrating a second step of the method of making the chip resistor.

Next, as shown in FIG. 9, one end of the bar A1 is cut off from the lead frame A. Then, the ends of the bar A1 are respectively connected to a conducting probe for measuring resistance value at the resistor element 2. In this state, a trimming groove 6 is formed in the resistor element 2 by laser irradiation, for example, so that the resistor element 2 has the required resistance.

Figure 10:
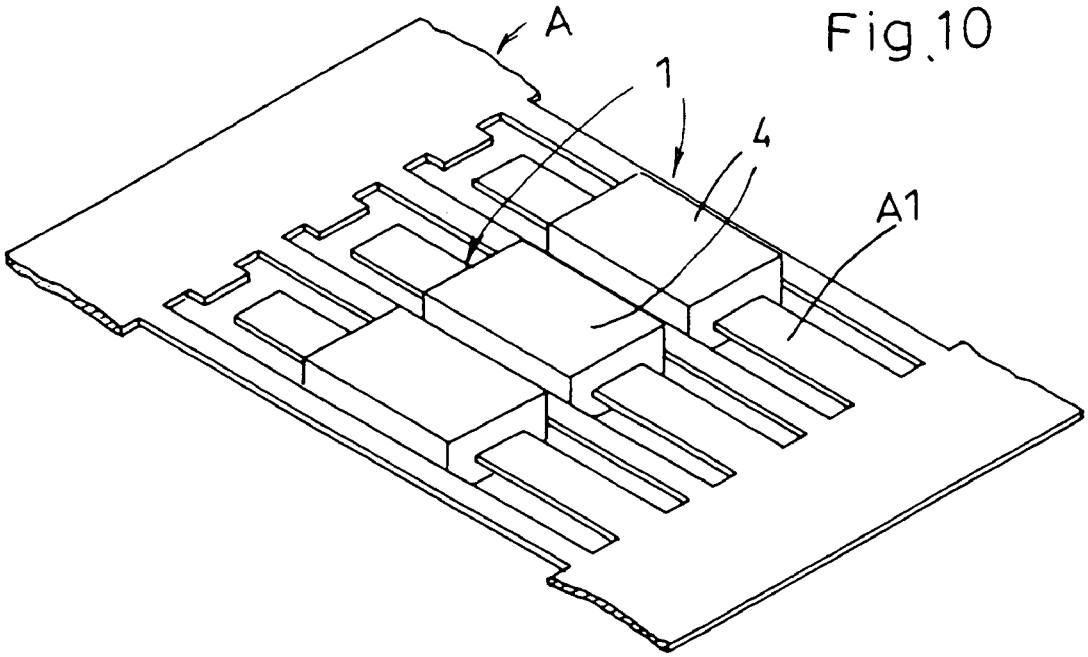
FIG. 10 is a perspective view illustrating a third step of the method of making the chip resistor.

Next, as shown in FIG. 10, the bar A1 is covered with an insulator 4 at the resistor element 2.

Figure 11:
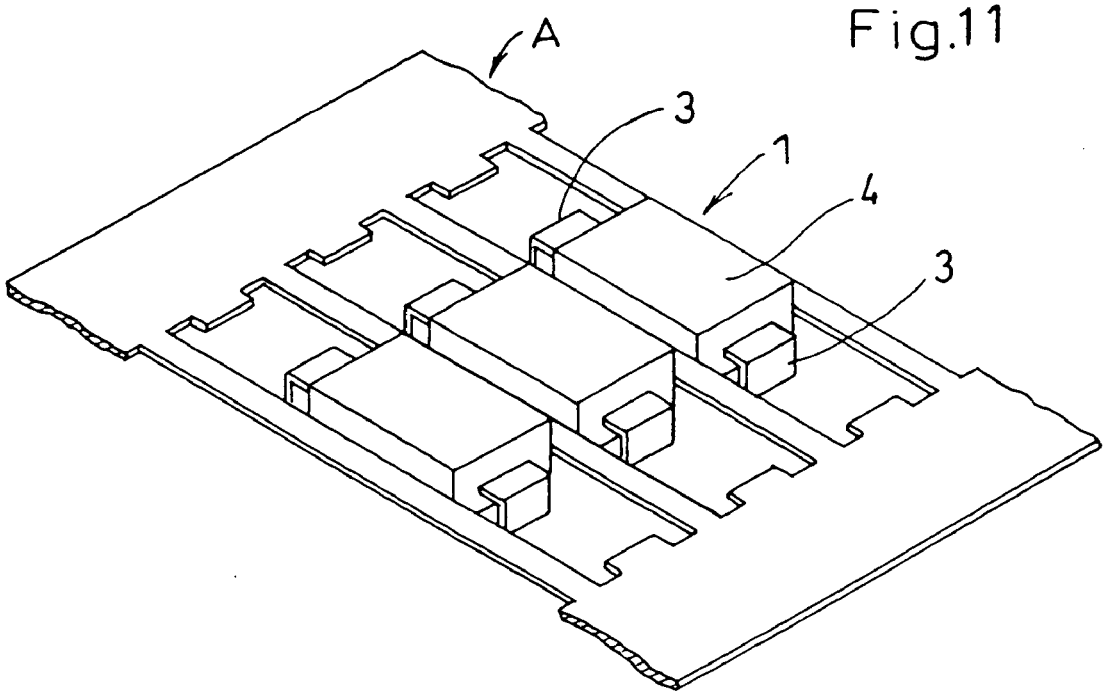
FIG. 11 is a perspective view illustrating a fourth step of the method of making the chip resistor.

Then, as shown in FIG. 11, the other end of the bar A1 is cut off from the lead frame A. Thereafter, a bending process for the terminal electrodes 3 is performed to produce a chip resistor 1 having the structure shown in FIGS. 1 and 2.

Figure 12:
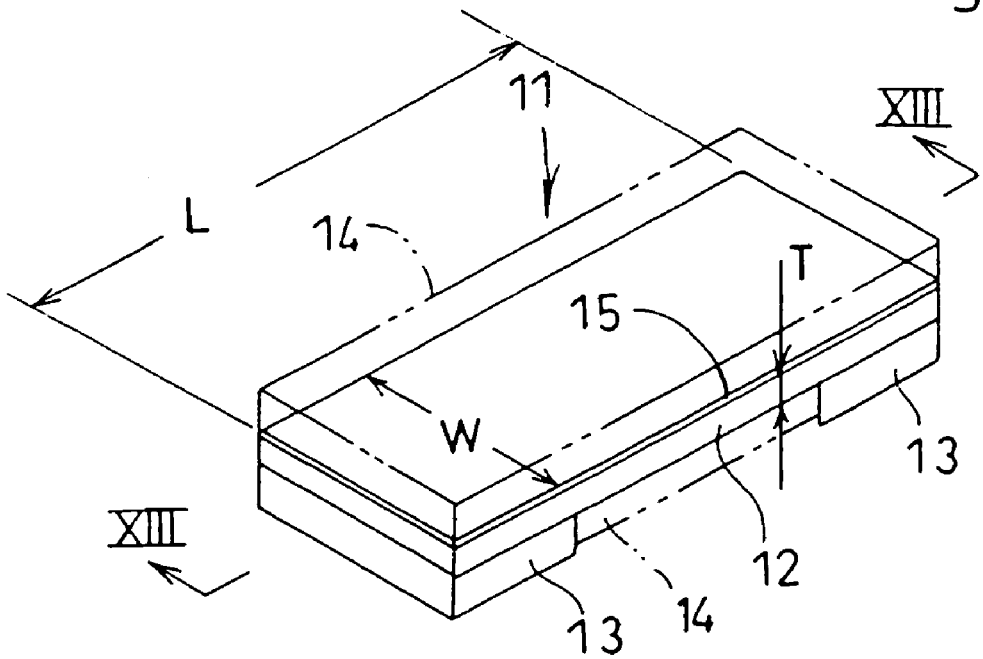
FIG. 12 is a perspective view illustrating a chip resistor according to a second embodiment of the present invention.
Figure 13:
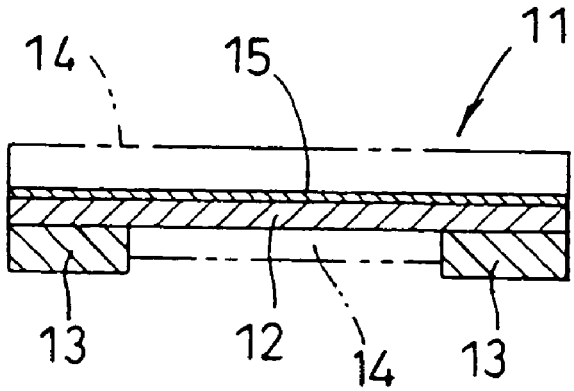
FIG. 13 is a section view taken along lines XIII-XIII in FIG. 12.

FIGS. 12-13 illustrates a chip resistor 11 according to a second embodiment of the present invention.

The chip resistor 11 includes a resistor element 12 which is a rectangular solid having a length L, width W, and a thickness T, a pair of connection terminal electrodes 13 fixed to the ends of the lower surface of the resistor element 12, and an insulator 14 for covering the resistor element 12.

Similarly to the first embodiment, the resistor element 12 is made of an alloy composed of a low resistance (hereinafter referred to as low-resistant metal) and a metal with high resistance (hereinafter referred to as high-resistant metal) such as copper-nickel alloy, nickel-chrome alloy, or iron-chrome alloy.

On the other hand, the terminal electrodes 13 are made of an alloy with resistance lower than that of the alloy making the resistor element 12, or of a pure metal such as copper.

The surface of the resistor element 2 is formed with a plating layer 15 which is made of a pure metal, such as copper or silver, which has resistance lower than that of the alloy making the resistor element 12.

Similarly to the fist embodiment, the resistance between the terminal electrodes 13 is lowered by the pure metal plating layer 15 formed on the alloy resistor element 12. Thus, the resistance between the terminal electrodes 13, namely the resistance of the chip resistor 11, can be lowered without increasing the percentage of the low-resistant metal relative to the high-resistant metal in the alloy making the resistor element 12, and without increasing the thickness T of the resistor element 12.

As readily understood, the structure shown in FIGS. 3-7 is applicable to the second embodiment.

In the second embodiment again, it is possible to prevent the chip resistor 11 from having a negative temperature coefficient of resistance, or possible to lower the negative temperature coefficient of resistance of the chip resistor 11 by making the resistor element 12 of an alloy having a negative temperature coefficient of resistance, such as a copper-nickel alloy composed of 43-45 wt % nickel and copper for the balance.

The chip resistor 11 of the second embodiment may be produced in the following manner.

Figure 14:
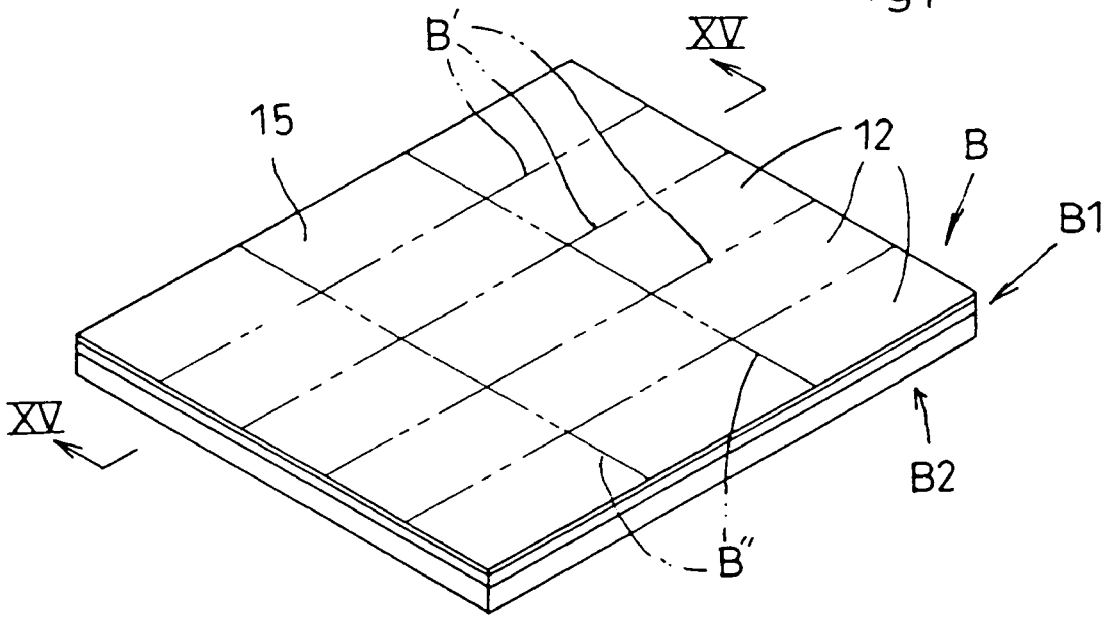
FIG. 14 is a perspective view illustrating a first step of a method of making the chip resistor.
Figure 15:
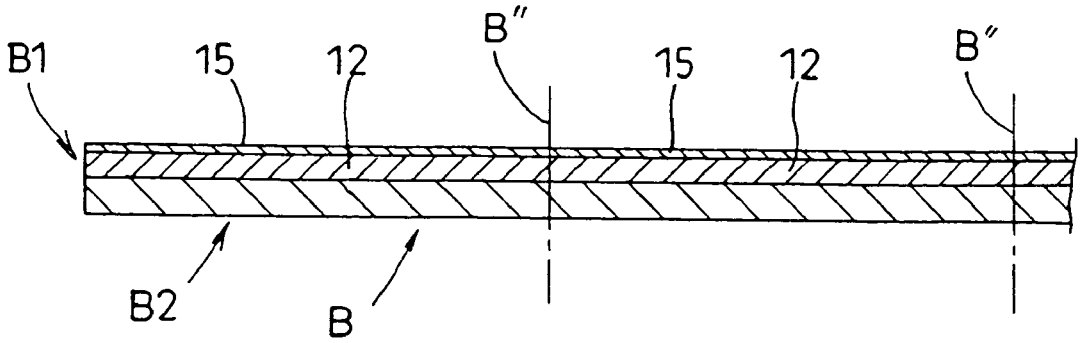
FIG. 15 is an enlarged section view taken along lines XV-XV in FIG. 14.

As shown in FIGS. 14-15, an alloy plate B1 for making a plurality of resistor elements 12, which are integrally aligned in rows thereon, is prepared. Then, a metal plate B2 for forming the terminal electrodes 13 is fixed to the lower surface of the resistor element alloy plate B1 to produce a laminated material metal plate B. The upper surface of the alloy plate B1 in the laminated material metal plate B is formed with a pure metal plating layer 15 disposed on each of the resistor elements 12.

Figure 16:
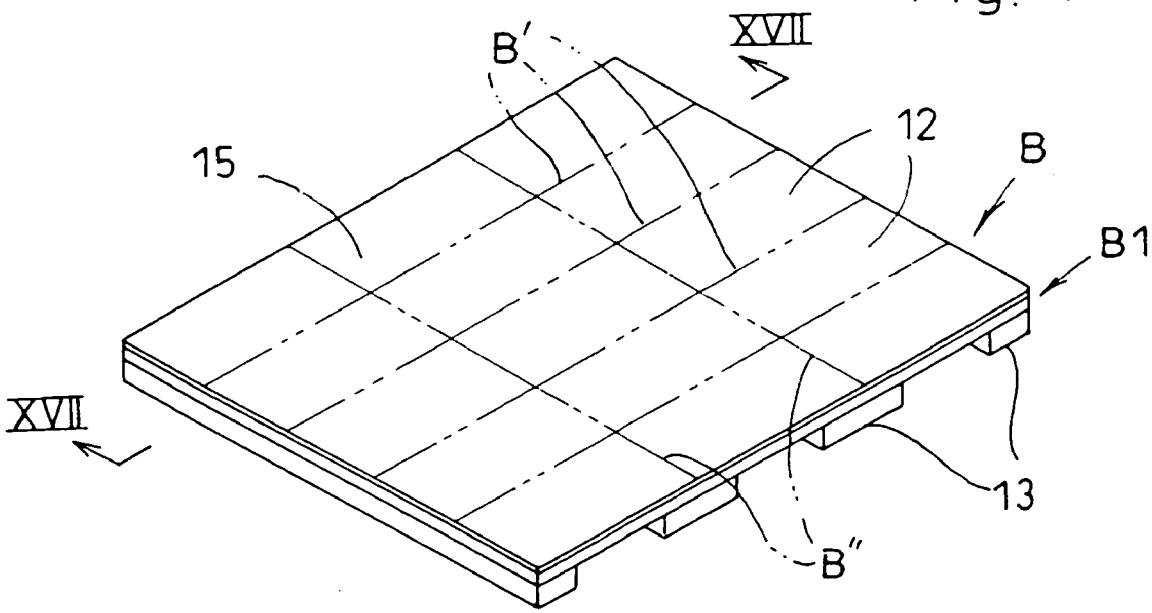
FIG. 16 is a perspective view illustrating a second step of the method of making the chip resistor.
Figure 17:
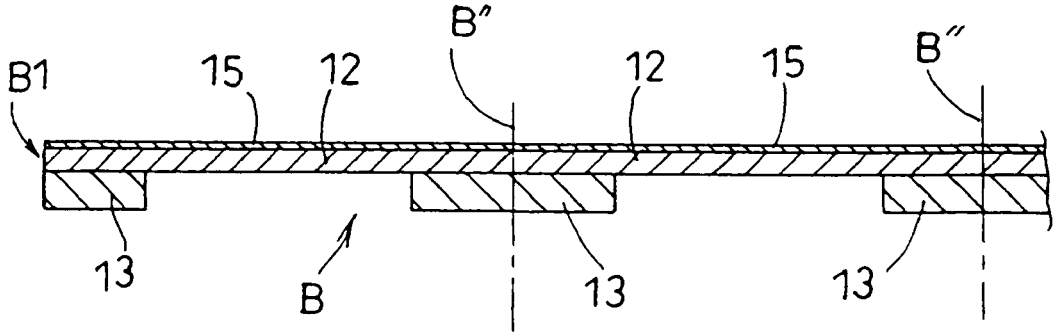
FIG. 17 is an enlarged section view taken along lines XVII-XVII in FIG. 16.

Then, as shown in FIGS. 16-17, the metal plate B2 of the laminated material metal plate B is cut or corroded so that portions other than those for forming the terminal electrodes 13 at the ends of the resistor elements 12 are removed.

Figure 18:
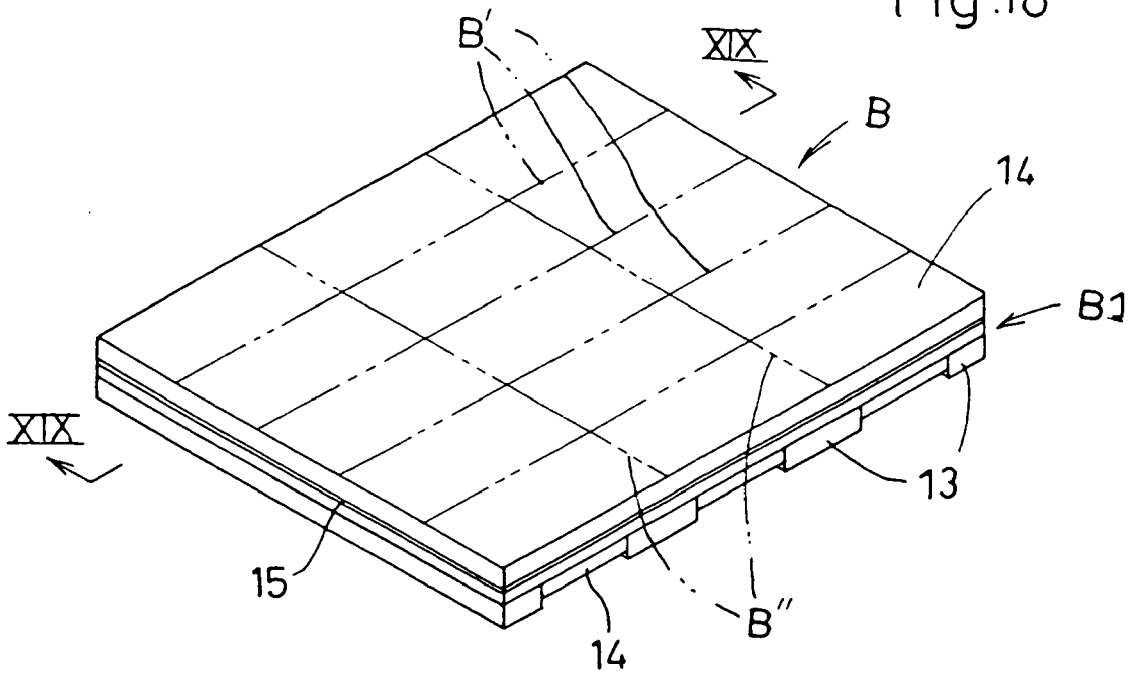
FIG. 18 is a perspective view illustrating a third step of the method of making the chip resistor.
Figure 19:
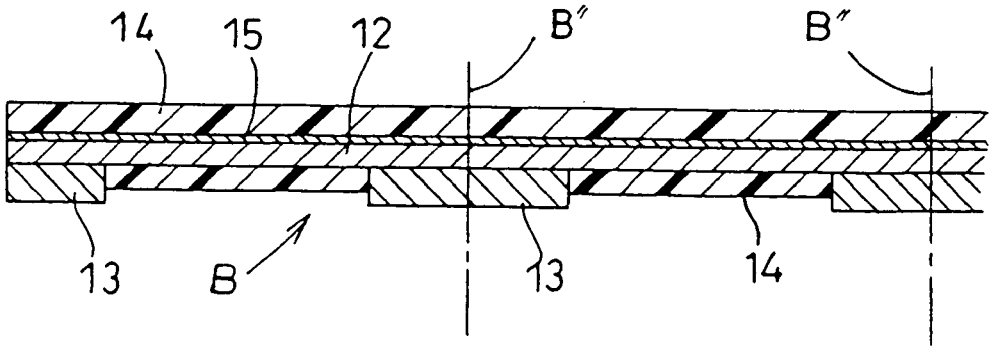
FIG. 19 is an enlarged section view taken along lines XIX-XIX in FIG. 18.

Then, as shown in FIGS. 18-19, the laminated material metal plate B is covered by insulators 14 at the entire upper surface of the alloy plate B1 and at the portions between each of the terminal electrodes 13.

Finally, the laminated material metal plate B is cut at lengthwise cutting lines B' and crosswise cutting lines B" for dividing into resistor elements 12. In this way, the chip resistor 11 shown in FIGS. 12-13 is made.

In the above method, the process for forming a pure metal plating layer 15 on the upper surface of the alloy plate B1 of the laminated material metal plate B may be performed after the process for processing the metal plate B2 of the laminated material metal plate B to remove the portions other than the portions for forming the terminal electrodes 13.

Figure 20:
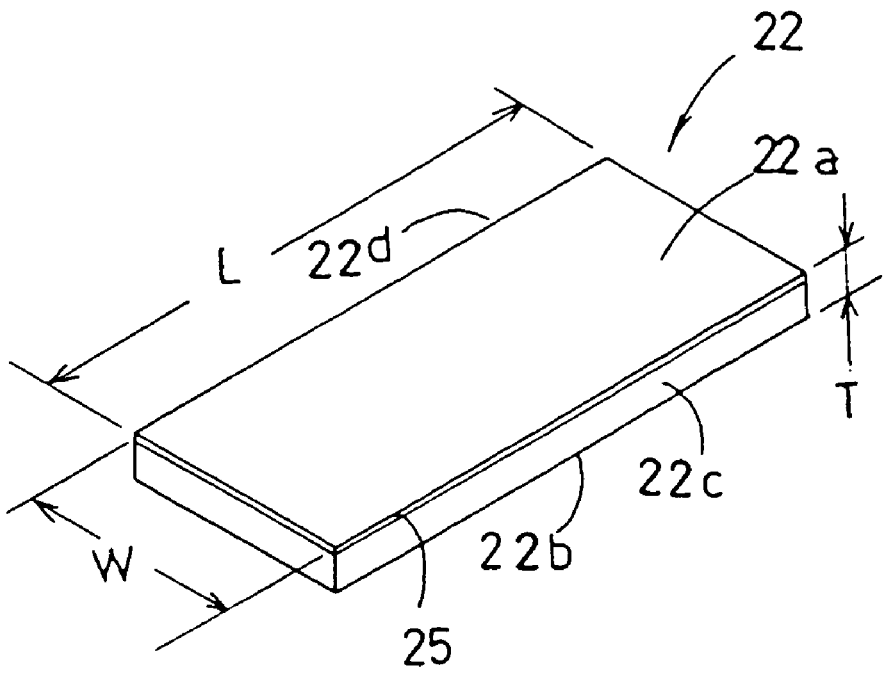
FIG. 20 is a perspective view illustrating a resistor element according to a third embodiment of the present invention.

A third embodiment of the present invention is described below referring to FIGS. 20-26. FIG. 20 illustrates a resistor element 22 which is a rectangular solid having a length L, width W, and thickness T. The resistor element 22 is made of an alloy composed of a metal with low resistance (hereinafter referred to as low-resistant metal) and a metal with high resistance (hereinafter referred to as high-resistant metal), such as copper-nickel alloy, nickel-chrome alloy, or iron-chrome alloy, for example. A metal plate with a thickness T made of such alloy is formed into a rectangle having a length L and a width W.

The resistor element 22 is formed with a plating layer 25 which is made of a pure metal such as copper or silver with resistance lower than that of the alloy making the resistor element 22. Similarly to the first embodiment, the resistance between connection terminal electrodes 23, 23' is lowered by the pure metal plating layer 25 which is formed on the alloy resistor element 2. Thus, the resistance between the terminal electrodes 23, 23', which is the resistance of a chip resistor 21, can be lowered without increasing the percentage of the low-resistant metal relative to the high-resistant metal in the alloy making the resistor element 22, and without increasing the thickness T of the resistor element 22.

As readily understood, the structure shown in FIGS. 3-7 may be applied to the third embodiment.

Figure 21:
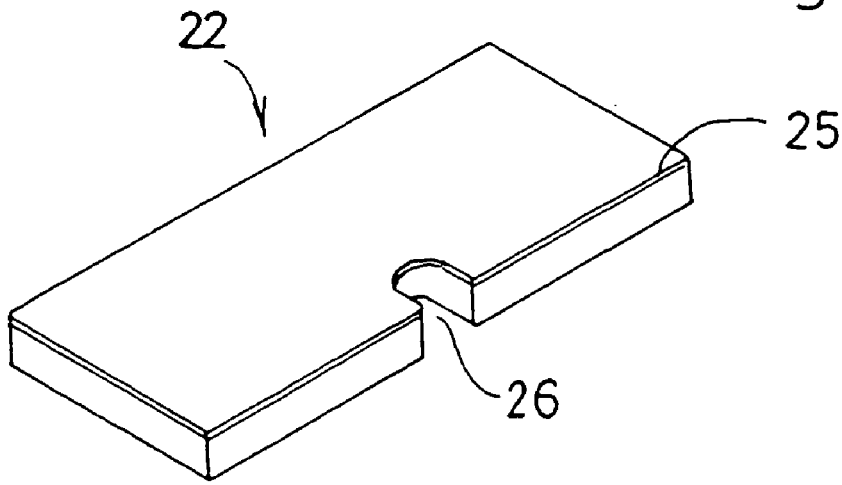
FIG. 21 is a perspective view illustrating the resistor element which is formed a trimming groove for adjusting resistance thereof.

The resistor element 22 is formed with a trimming groove 26 by laser irradiation, as shown in FIG. 21, during which the ends of the resistor element 22 are respectively connected to a conducting probe for measuring resistance at the resistor element 2. In this way, the resistance of the resistor element 22 is adjusted to the required value.

Figure 22:
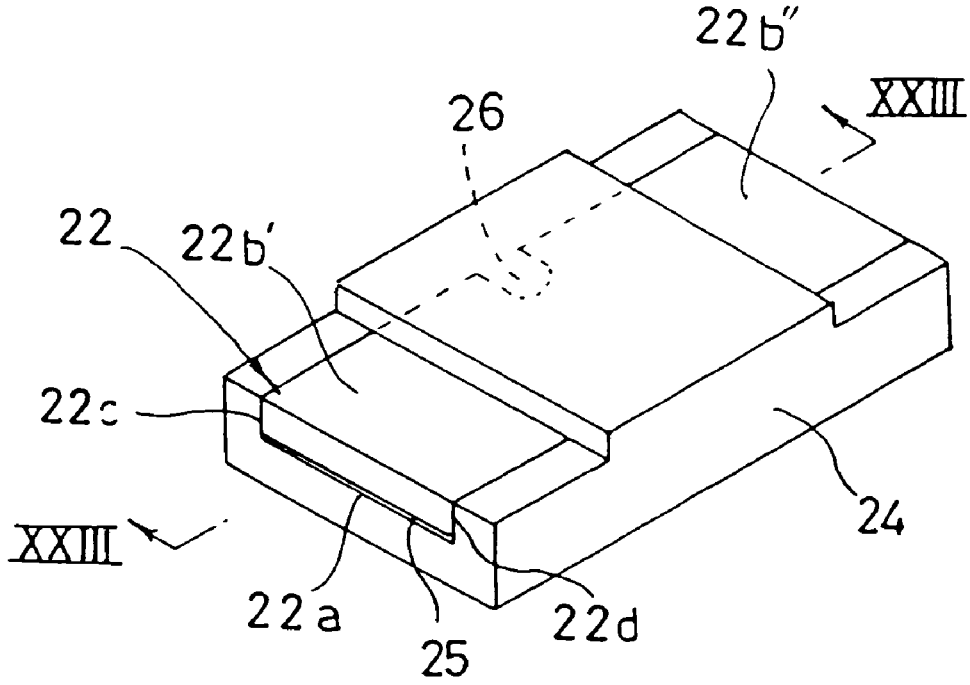
FIG. 22 is a perspective vie was seen from the lower surface of the resistor element which is covered by an insulator.
Figure 23:
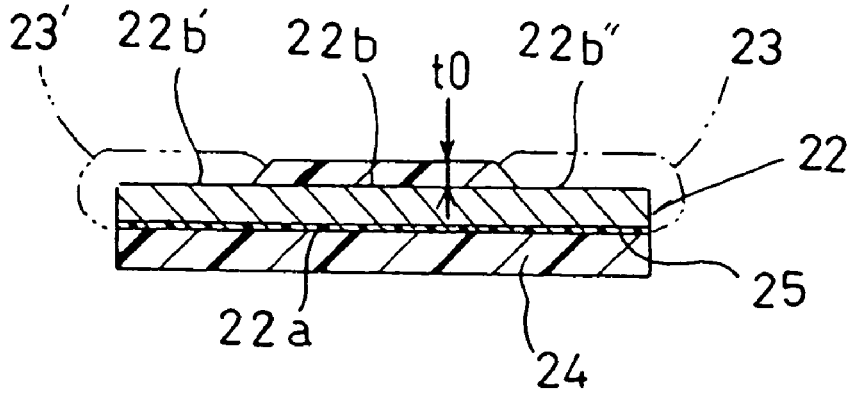
FIG. 23 is a section view taken along lines XXIII-XXIII in FIG. 22.

As shown in FIGS. 22-23, an upper surface 22*a*, a lower surface 22*b*, and side surfaces 22*c*, 22*d* of the resistor element 22 are covered by an insulator 4 which is made of heat-resistant synthetic resin or glass. The insulator 4 is not formed on the end portions 22*b*', 22*b*" on the lower surface 22*b* of the resistor element 22 to expose these portions.

Then, a plurality of elements are put into a barrel-plating container to perform plating with the use of pure metal such as copper or silver. As a result, metal plating layers 23, 23, to serve as connection terminal electrodes at the ends of the resistor element 22 are formed on the non-covered portions of the resistor element 22, that is, the end portions 22b', 22b" of the lower surface 22*b* of the resistor element 22.

Figure 24:
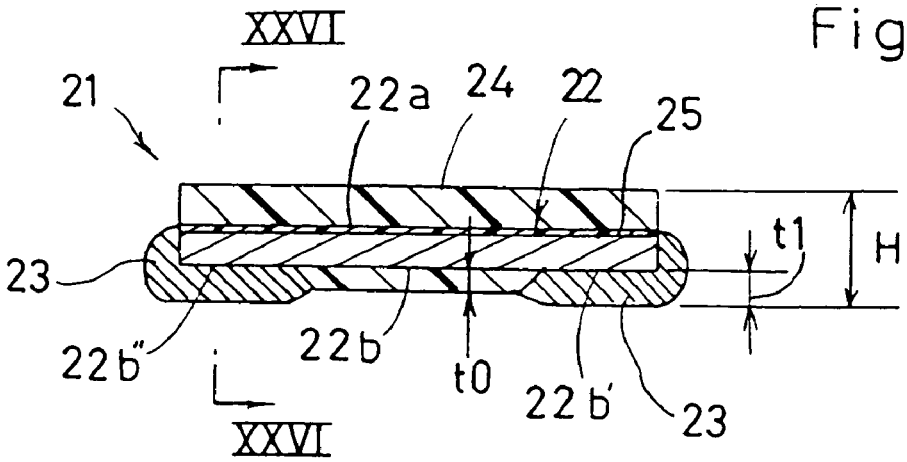
FIG. 24 is a front view in vertical section illustrating a chip resistor according to a third embodiment of the present invention.
Figure 25:
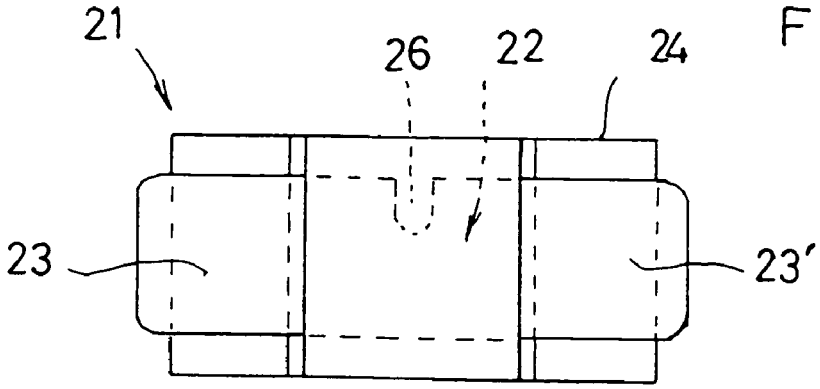
FIG. 25 is a bottom view of the chip resistor in FIG. 24.
Figure 26:
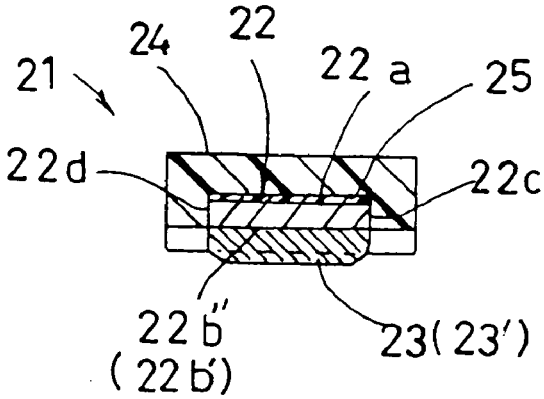
FIG. 26 is a section view taken along lines XXVI-XXVI in FIG. 24.

Through the above-described process, the chip resistor 21 shown in FIGS. 24-26 is obtained.

As described above, the chip resistor 21 includes the resistor element 22 made of a metal plate which is formed into a rectangle and the insulator 24 which covers the upper surface 22*a*, lower surface 22*b*, and side surfaces 22*c*, 22*d* of the resistor element 22 other than the end portions 22*b*', 22*b*" of the lower surface 22*b*. The chip resistor further includes the metal layers 23, 23' made of metal with resistance lower than that of the metal making the resistor element 22, such as copper or silver. The metal layers 23, 23' are formed on the exposed end portions 22*b*', 22*b*" without the insulator 24 on the lower surface 22*b* of the resistor element 22, while serving as connection terminal electrodes at the ends of the resistor element 22.

With such an arrangement, the metal layers 23, 23' serve as connection terminal electrodes at the ends of the resistor element 22. Thus, the thickness of the terminal electrodes can be reduced by thin metal layers 23, 23' at the ends of the resistor element 22, whereby the height H of the chip resistor 21 is advantageously low.

Further, when the chip resistor is soldered to e.g. a printed circuit board, the insulator 24 covering the lower surface 22*b* prevents melted solder from swelling up to the lower surface 22*b* of the resistor element 22.

In this connection, it should be noted that the insulator 24 also covers the upper surface 22*a* and the side surfaces 22*c*, 22*d* of the resistor element 22. Due to this structure, when the chip resistor is soldered to e.g. a printed circuit board, the insulator reliably prevents melted solder from swelling up to the upper surface 22*a* and/or the side surfaces 22*c*, 22*d* of the resistor element 22.

The metal layers 23, 23' may have a thickness t1 which is equal to or larger than the thickness t0 of the insulator 24 at the portion covering the lower surface of the resistor element 22. Due to this structure, in soldering the chip resistor to e.g. a printed circuit board, the metal layers 23, 23' are nearly or completely prevented from lifting up from the printed circuit board.

For producing the chip resistor 21 with the above structure, use may be made of a lead frame described below.

Figure 27:
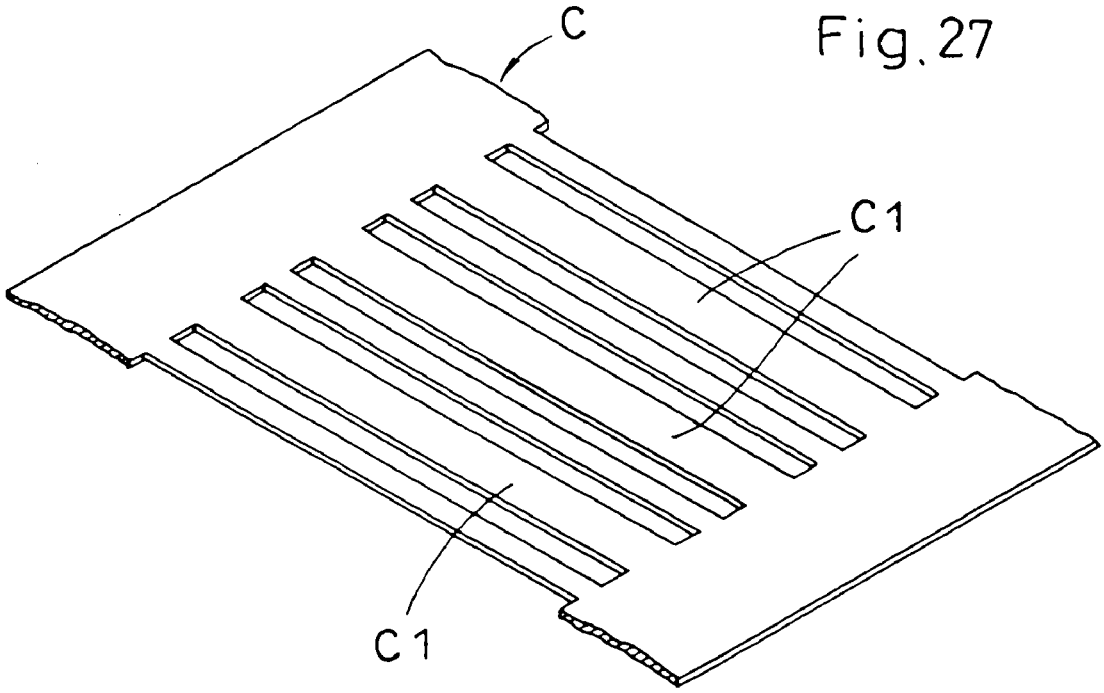
FIG. 27 is a perspective view illustrating a lead frame for making a chip resistor.

As shown in FIG. 27, a lead frame C is punched out of a metal plate with a predetermined thickness. A plurality of lead bars C1 for forming resistor elements 22 are arranged integrally therewith at lengthwise intervals. The surface of each resistor element 22 is formed with a pure metal plating layer 25.

Figure 28:
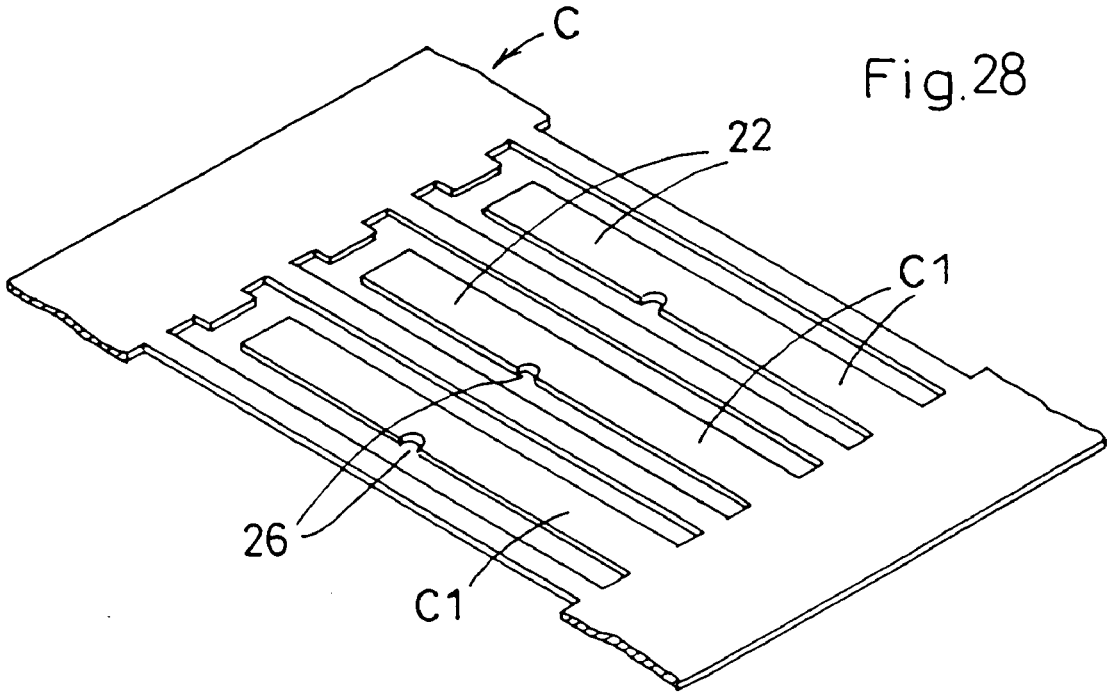
FIG. 28 is a perspective view illustrating a first step of a method of making the chip resistor using the lead frame.

Then, as shown in FIG. 28, one end of the bar C1 is cut off from the lead frame C. The ends of the bar C1 for forming the resistor element 22 are respectively connected to a conducting probe for measuring resistance value at the resistor element 22. In this state, a trimming groove 26 is formed in the resistor element 22 by laser irradiation, so that the resistance of the resistor element 22 is adjusted to the required value.

Figure 29:
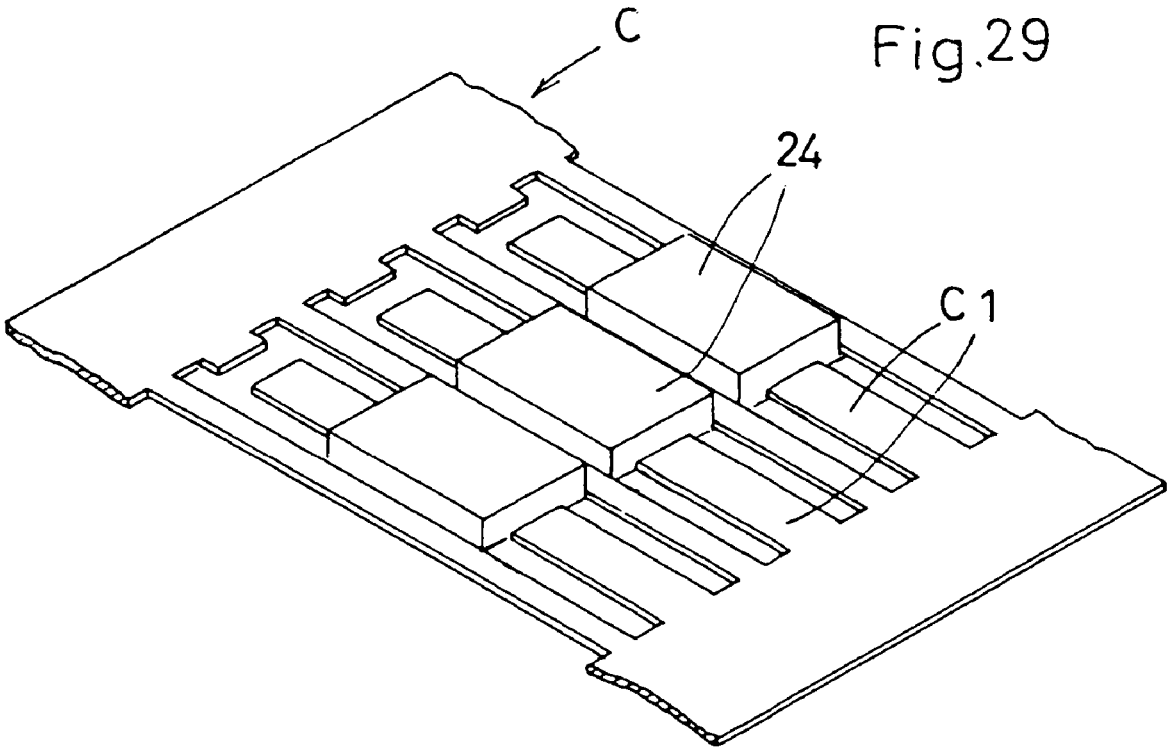
FIG. 29 is a perspective view illustrating a second step of the method of making the chip resistor using the lead frame.

Then, as shown in FIG. 29, the portion of the bar C1 for forming the resistor element 22 is partly covered by an insulator 24, as in the embodiments described above.

Then, the resistor element 22 formed out of the bar C1 is cut off from the lead frame C. Thereafter, a plating process such as barrel-plating is performed for forming metal layers 23, 23, serving as the terminal electrodes for the resistor element 22. Thus, the desired chip resistor 21 is obtained. Alternatively, the metal plating layers 23, 23' may be formed on the exposed portions of the resistor element 22 in each bar C1, and then the resistor element is cut off the frame A to provide the chip resistor 21.

As seen from the above, the use of the lead frame C for making the chip resistor 21 contributes to reduction in production cost.

The invention claimed is:

1. A chip resistor having low resistance comprising: a rectangular resistor element formed of an alloy of high-resistance metal and low-resistance metal; and connection terminal electrodes formed at ends of the resistor element;

wherein a surface of the resistor element is formed with a plating layer made of pure metal with resistance lower than that of the alloy making the resistor element, the plating layer extending continuously from one end of the resistor element to the other end of the resistor element.

2. The chip resistor having low resistance according to claim 1, wherein the alloy making the resistor element has a negative temperature coefficient of resistance.

3. The chip resistor having low resistance according to claim 1, wherein the resistor element is formed with a sectional area reducing portion, the sectional area reducing portion being filled with the plating layer.

4. The chip resistor having low resistance according to claim 2, wherein the resistor element is formed with a sectional area reducing portion, the sectional area reducing portion being filled with the plating layer.

5. The chip resistor having low resistance according to claim 1, wherein the plating layer on the surface of the resistor element is narrowed at least partially between the connection terminal electrodes.

6. The chip resistor having low resistance according to claim 5, wherein the connection terminal electrodes are integrally extended from the ends of the resistor element toward a lower surface of the resistor element, the plating layer being extended onto a surface of the extended electrodes.

7. The chip resistor having low resistance according to claim 5, wherein metal plates serving as the connection terminal electrodes are fixed to a lower surface of the resistor element at the ends thereof, and wherein an insulator covers an upper surface of the resistor element together with the plating layer while also covering a portion between the connection terminal electrodes on the lower surface of the resistor element.

8. The chip resistor having low resistance according to claim 5, wherein at least a lower surface of the resistor element except for the ends thereof is covered by an insulator, the lower surface of the resistor element being formed with an additional metal plating layer the ends of the resistor element, the additional metal plating layer serving as the connection terminal electrode of the resistor element.

9. The chip resistor having low resistance according to claim 8, wherein the additional metal plating layer formed at the ends of the lower surface has a thickness equal to or larger than a thickness of the insulator covering the lower surface of the resistor element.

10. The chip resistor having low resistance according to claim 8, wherein an upper surface and a pair of side surfaces of the resistor element are covered by an additional insulator.

11. The chip resistor having low resistance according to claim 1, wherein the connection terminal electrodes are integrally extended from the ends of the resistor element toward a lower surface of the resistor element, the plating layer being extended onto a surface of the extended electrodes.

12. The chip resistor having low resistance according to claim 1, wherein metal plates serving as the connection terminal electrodes are fixed to a lower surface of the resistor element at the ends thereof, and wherein an insulator covers an upper surface of the resistor element together with the plating layer while also covering a portion between the connection terminal electrodes on the lower surface of the resistor element.

13. The chip resistor having low resistance according to claim 1, wherein at least a lower surface of the resistor element except for the ends thereof is covered by an insulator, the lower surface of the resistor element being formed with an additional metal plating layer at the ends of the resistor element, the additional metal plating layer serving as the connection terminal electrode of the resistor element.

14. The chip resistor having low resistance according to claim 13, wherein the additional metal plating layer formed at the ends of the lower surface has a thickness equal to or larger than a thickness of the insulator covering the lower surface of the resistor element.

15. The chip resistor having low resistance according to claim 13, wherein an upper surface and a pair of side surfaces of the resistor element are covered by an additional insulator.

16. A method of making a chip resistor having low resistance, the chip resistor comprising a rectangular resistor element formed of an alloy of high-resistance metal and low-resistance metal, and connection terminal electrodes formed at the ends of the resistor element, wherein a surface of the resistor element is formed with a plating layer made of pure metal with resistance lower than that of the alloy making the resistor element, the plating layer extending continuously from one end of the resistor element to the other end of the resistor element, the method comprising the steps of:

preparing a lead frame integrally formed with a plurality of lead bars each for forming a resistor element, the preparation using an alloy plate of high-resistance metal and low-resistance metal;

forming a pure metal plating layer on a surface of the resistor element in each bar of the lead frame;

adjusting resistance of the resistor element in each bar of the lead frame; and cutting the resistor element in each bar off the lead frame after an insulator for covering the resistor element is formed.

17. A method of making a chip resistor having low resistance, the chip resistor comprising a rectangular resistor element formed of an alloy of high-resistance metal and low-resistance metal, and connection terminal electrodes formed at the ends of the resistor element, wherein a surface of the resistor element is formed with a plating layer made of pure metal with resistance lower than that of the alloy making the resistor element, the plating layer extending continuously from one end of the resistor element to the other end of the resistor element, the method comprising the steps of:

preparing a laminated material metal plate by fixing a resistor element alloy plate and a connection terminal electrode metal plate to each other, the alloy plate being made of an alloy composed of high-resistance metal and low-resistance metal corresponding to a plurality of resistor elements, the connection terminal electrode metal plate being made of a metal having resistance lower than the alloy plate;

removing portions of the connection terminal electrode metal plate so as to leave connection terminal electrodes after a plating layer of pure metal is formed on an upper surface of the resistor element alloy plate in the laminated material metal plate, or forming a plating layer of pure metal on an upper surface of the resistor element alloy plate after portions of the connection terminal electrode metal plate in the laminated material metal plate are removed so as to leave connection terminal electrodes;

forming insulators for covering the upper surface of the alloy plate and a part of the lower surface of the connection terminal electrode metal plate other than the connection terminal electrodes; and cutting the laminated material metal plate into the plurality of resistor elements.

18. A method of making a chip resistor having low resistance, the chip resistor comprising a rectangular resistor element formed of an alloy of high-resistance metal and low-resistance metal, and connection terminal electrodes formed at the ends of the resistor element, wherein a surface of the resistor element is formed with a plating layer made of pure metal with resistance lower than that of the allow making the resistor element, the plating layer extending continuously from one end of the resistor element to the other end of the resistor element, the method comprising the steps of:

making a rectangular resistor element from a metal plate;

forming a pure metal plating layer on a surface of the resistor element;

forming an insulator for covering at least a lower surface of the resistor element at a portion other than ends thereof; and forming an additional metal plating layer serving as connection terminal electrodes of the resistor element on the lower surface of the resistor element at the ends thereof not covered by the insulator.

19. A method of making a chip resistor having low resistance, the chip resistor comprising a rectangular resistor element formed of an alloy of high-resistance metal and low-resistance metal, and connection terminal electrodes formed at the ends of the resistor element, wherein a surface of the resistor element is formed with a plating layer made of pure metal with resistance lower than that of the allow making the resistor element, the plating layer extending continuously from one end of the resistor element to the other end of the resistor element, the method comprising the steps of:

making a rectangular resistor element from a metal plate;

forming a pure metal plating layer on a surface of the resistor element;

forming insulators for covering an upper surface, a lower surface, and a pair of side surfaces of the resistor element except for ends of the lower surface; and forming an additional metal plating layer serving as connection terminal electrodes of the resistor element at the ends of the lower surface of the resistor element not covered by the insulator.

20. A method of making a chip resistor having low resistance, the chip resistor comprising a rectangular resistor element formed of an alloy of high-resistance metal and low-resistance metal, and connection terminal electrodes formed at the ends of the resistor element, wherein a surface of the resistor element is formed with a plating layer made of pure metal with resistance lower than that of the allow making the resistor element, the plating layer extending continuously from one end of the resistor element to the other end of the resistor element, the method comprising the steps of:

preparing a lead frame integrally formed with a plurality of lead bars each for making a resistor element, the preparation using a metal plate;

forming a pure metal plating layer on a surface of the resistor element in each bar of the lead frame;

forming an insulator for covering at least a lower surface of the resistor element in each bar of the lead frame except for ends of the lower surface; and cutting off the resistor element in each lead bar from the lead frame before an additional metal plating layer serving as connection terminal electrodes of the resistor element are formed at the ends of the lower surface of the resistor element not covered by the insulator, or forming an additional metal plating layer serving as connection terminal electrodes of the resistor element in each bar at the ends of the lower surface of the resistor element before the resistor element is cut off from the lead frame.

* * * * *